US010101110B2

(12) United States Patent
Faifer et al.

(10) Patent No.: US 10,101,110 B2
(45) **Date of Patent: *Oct. 16, 2018**

(54) PISTOL GRIP BIPOD

(71) Applicants: Sagi Faifer, Mishmar Hashiva (IL); Tamir Porat, Tel Aviv (IL)

(72) Inventors: Sagi Faifer, Mishmar Hashiva (IL); Tamir Porat, Tel Aviv (IL)

( * ) Notice: Subject to any disclaimer, the term of this patent is extended or adjusted under 35 U.S.C. 154(b) by 0 days.

This patent is subject to a terminal disclaimer.

(21) Appl. No.: 15/168,202

(22) Filed: May 30, 2016

(65) Prior Publication Data

US 2016/0273864 A1 Sep. 22, 2016

Related U.S. Application Data

(63) Continuation of application No. 14/680,037, filed on Apr. 6, 2015, now Pat. No. 9,354,012.

(60) Provisional application No. 61/975,818, filed on Apr. 5, 2014.

(51) Int. Cl.

| | |
|---|---|
| ***F41A 23/10*** | (2006.01) |
| ***F41C 23/04*** | (2006.01) |
| ***F41C 23/16*** | (2006.01) |

(52) U.S. Cl.

CPC ..... *F41A 23/10* (2013.01); *F41C 23/04* (2013.01); *F41C 23/16* (2013.01)

(58) Field of Classification Search

CPC ..... F41A 23/04–23/16

See application file for complete search history.

(56) References Cited

U.S. PATENT DOCUMENTS

| | | | | |
|---|---|---|---|---|
| 7,111,424 | B1 | 9/2006 | Moody | |
| 7,121,034 | B2 | 10/2006 | Keng | |
| 7,409,791 | B2 | 8/2008 | Moody | |
| 7,421,815 | B1 | 9/2008 | Moody | |
| 7,568,304 | B1 | 8/2009 | Moody | |
| 7,665,239 | B1 | 2/2010 | Moody | |
| 7,669,357 | B2 | 3/2010 | Moody | |
| 7,743,545 | B1 | 6/2010 | Moody | |
| 7,823,855 | B2 * | 11/2010 | Faifer | F16M 11/041 248/166 |
| 7,909,301 | B2 * | 3/2011 | Faifer | F16M 11/041 248/166 |
| D644,707 | S | 9/2011 | Faifer | |
| 8,707,604 | B2 * | 4/2014 | Troy | F41A 23/10 248/169 |

(Continued)

*Primary Examiner* — Stephen Johnson
*Assistant Examiner* — Joshua T Semick
(74) *Attorney, Agent, or Firm* — Law Office of Arthur M. Antonelli, PLLC

(57) ABSTRACT

A pistol grip bipod for a gun may include a bipod assembly that can be attached to a pistol grip of a gun. The bipod assembly may include a housing, a chassis, a port side leg including a port side foot, a starboard side leg including a starboard foot. The bipod assembly further may include first and second operable states such that in the first operational state, the port side foot and the starboard side foot are secured in the housing below the pistol grip, and such that in the second operable configuration the port side foot and the starboard side foot are unlatched from the housing and the port side foot and the starboard side foot are positioned in front of the housing. The pistol grip bipod may be deployed by an operator's dominant hand which remains secured to the pistol grip.

26 Claims, 13 Drawing Sheets

(56) References Cited

U.S. PATENT DOCUMENTS

| | | | | |
|---|---|---|---|---|
| 9,354,012 | B2 * | 5/2016 | Faifer | F41A 23/10 |
| 2008/0052979 | A1 * | 3/2008 | Lee | F41A 23/04 42/94 |
| 2009/0038199 | A1 | 2/2009 | Oz | |
| 2009/0038200 | A1 | 2/2009 | Keng | |

* cited by examiner

FIG. 7
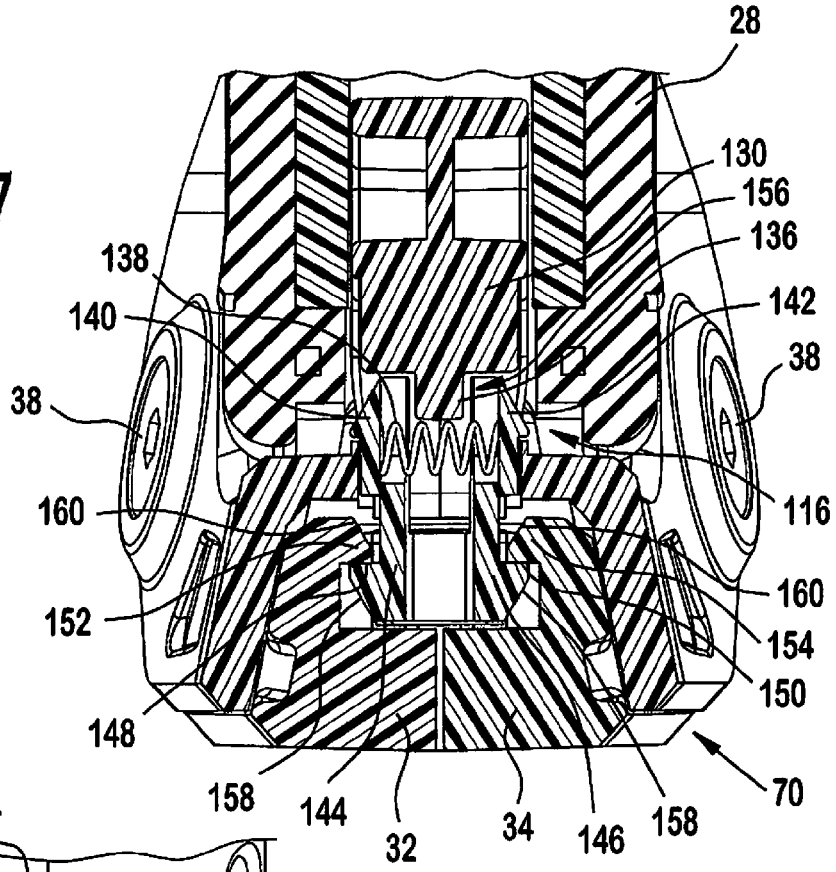
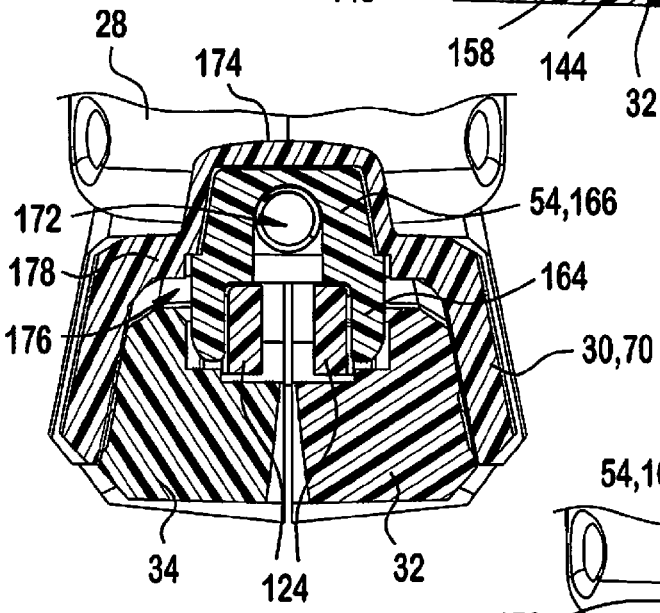
FIG. 8
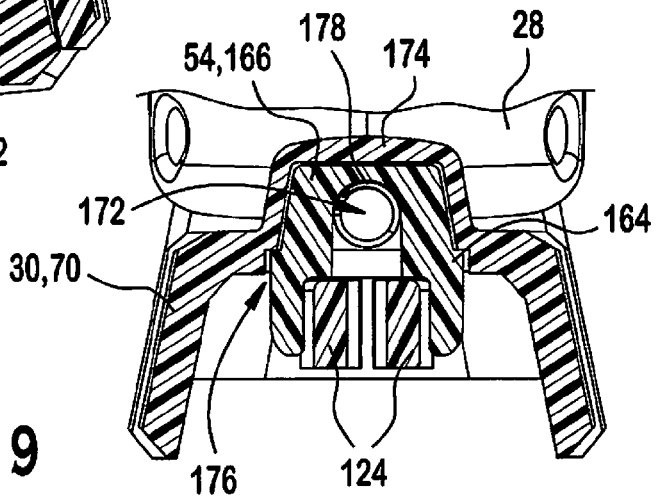
FIG. 9

FIG. 15
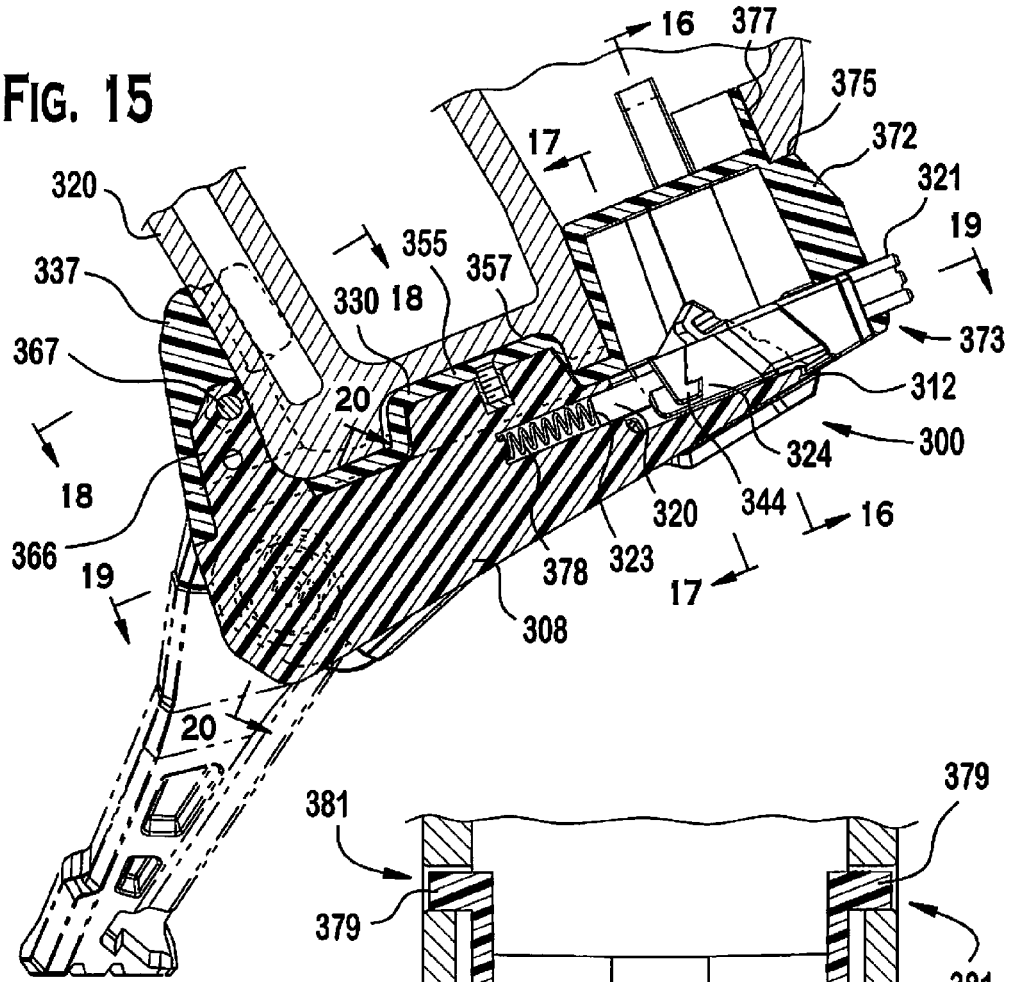
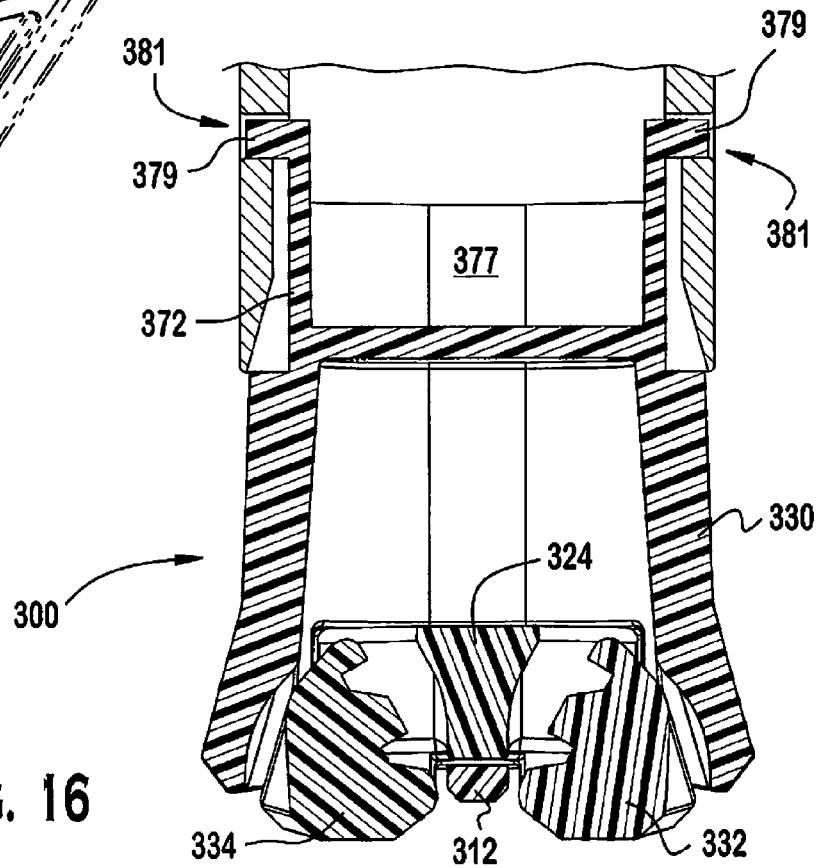
FIG. 16

FIG. 20
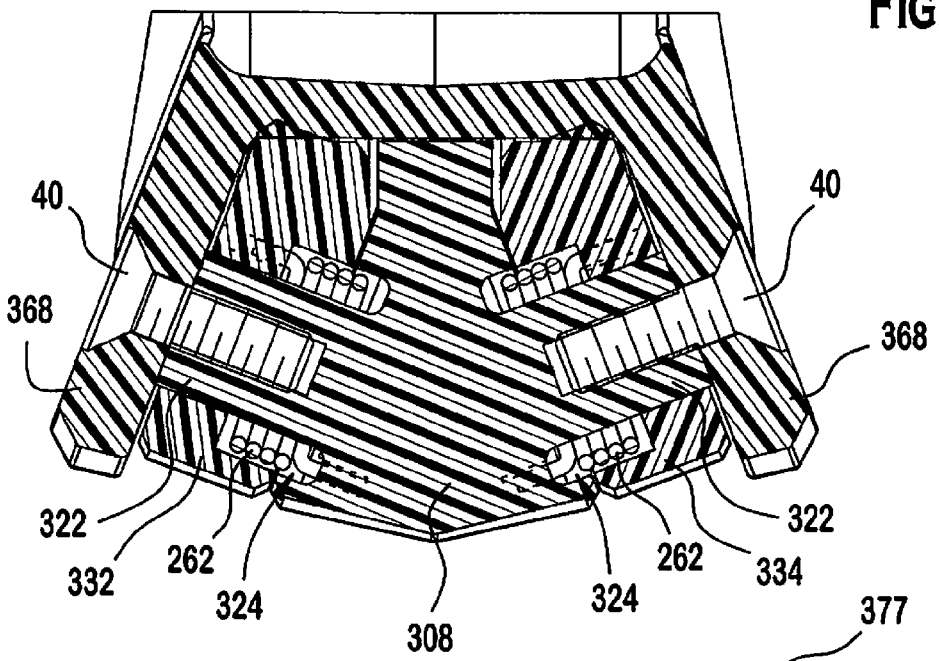
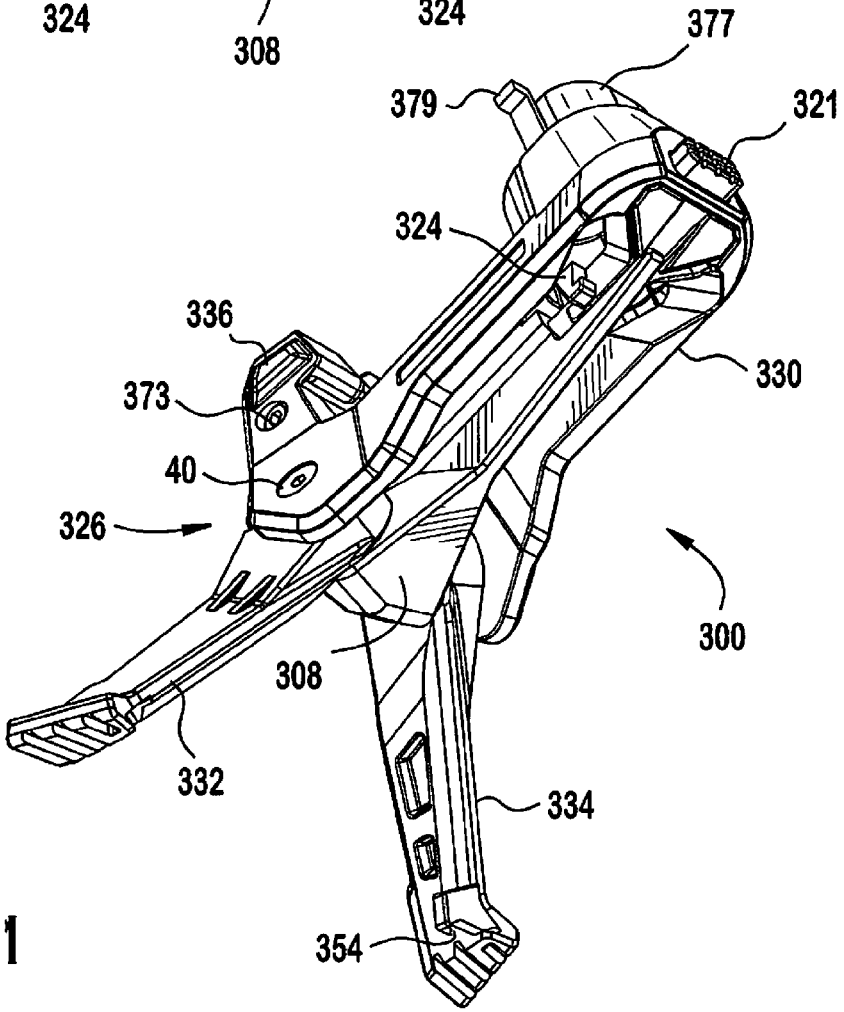
FIG. 21

PISTOL GRIP BIPOD

CROSS REFERENCE TO RELATED APPLICATIONS

This is a continuation of application Ser. No. 14/680,037, filed Apr. 6, 2015, pending, which claims the benefit of U.S. Provisional Application No. 61/975,818 filed on Apr. 5, 2014. Each of the above-identified applications are incorporated by reference herein in their entirety.

FIELD OF THE INVENTION

The invention relates to a bipod for a small arms weapon. More particularly, the invention relates to a retractable bipod that may be attached to a pistol grip of a gun.

BACKGROUND

Bipods may be used on small arms, such as rifles and machine guns, to provide a forward rest and reduce motion. Bipods may permit operators to rest a weapon on objects, like the ground or a wall, reducing fatigue and increasing accuracy and stability. Bipods may be a fixed or adjustable length. Some bipods (e.g., the bipod disclosed in U.S. Pat. No. 7,909,301) may be collapsed into a vertical foregrip. Weapon systems such as an M4 carbine may be deployed against an enemy at short range (e.g., close quarters combat) in which a vertical foregrip may not enhance proficient use of the weapon. Instead, a traditional or modified foregrip may be preferred. Accordingly, a small arms operator may forego a bipod in favor of a traditional or modified foregrip.

SUMMARY

Hence, the present invention is directed toward a pistol grip bipod for a gun, which may include a bipod assembly for attachment to a pistol grip of a gun. The bipod assembly may include a housing, which includes a front portion and a rear portion. The housing further may include a mast section adjacent to the front portion. The mast section may include a brace for stabilizing the housing with respect to a gun and a notch in the brace for attachment to a gun forward of a trigger. The housing further may include a receptacle section adjacent to the rear portion. The receptacle section may include a stem, and a mounting block. The mounting block may include an attachment structure for a pistol grip such that the attachment structure is configured and dimensioned to mate with a pistol grip of a gun. The housing further may include an intermediate section disposed between the mast section and the receptacle section, as well as a chassis connected to the intermediate section. The chassis may include a neck, a port side spindle, a starboard side spindle, and a tail which includes a seat. The bipod assembly may include a port side leg connected to the port side spindle, the port side leg including a port side foot, the head of the port side leg being pivotally connected to the port side spindle. Also, the bipod assembly may include a starboard side leg connected to the starboard side spindle, the starboard side leg including a starboard foot, the head of the starboard side leg being pivotally connected to the starboard side spindle. The bipod assembly further may include first and second operable states such that in the first operational state the port side foot and the starboard side foot are secured in the receptacle section below the mounting block, and such that in the second operable state the port side foot and the starboard side foot are unlatched from the housing and the port side foot and the starboard side foot are positioned in front of the housing.

In another aspect, the pistol grip bipod further may include a port side latch for selectively interlocking with a catch on the port side leg. Further still, the pistol grip bipod may include a starboard side latch for selectively interlocking with a catch on the starboard side leg.

In another aspect, the pistol grip bipod further may include a latching member that selectively positions the port side latch with respect to the catch on the port side leg. Moreover, the latching member may selectively position the starboard side latch with respect to the catch on the starboard side leg.

In another aspect, the latching member may include a first cantilever board disposed in the receptacle section of the housing. The latching member may include a second cantilever board disposed in the receptacle section of the housing.

In another aspect, the latching member may include a U-shaped resilient member. The latching member further may include an eyelet adjacent the U-shaped resilient member. The eyelet may be disposed around the stem. Also, the eyelet may be disposed between the seat and the housing.

In another aspect, the mounting block further may comprise an internal chamber, and the port side latch and the starboard side latch may be situated below the internal chamber.

DESCRIPTION OF THE DRAWINGS

In the accompanying drawings, which form part of this specification and are to be read in conjunction therewith and in which like reference numerals are used to indicate like parts in the various views:

FIG. 7 is a cross-sectional view of the pistol grip bipod of FIG. 4, along line 7-7;

FIG. 8 is a cross-sectional view of the pistol grip bipod of FIG. 4, along line 8-8 with the latching mechanism in a secured configuration;

FIG. 9 is a cross-sectional view of the pistol grip bipod of FIG. 4, along line 8-8 with the latching mechanism in a released configuration;

FIG. 15 is a cross-sectional view of the pistol grip bipod of FIG. 13, along line 15-15;

FIG. 16 is a cross-sectional view of the pistol grip bipod of FIG. 13, along line 16-16 with the bipod assembly in the retracted state;

FIG. 20 is a cross-sectional view of the pistol grip bipod of FIG. 13, along line 20-20 with the bipod assembly in the retracted state;

FIG. 21 is another perspective view of the pistol grip bipod of FIG. 13 in the deployed state.

DESCRIPTION

Figure 1:
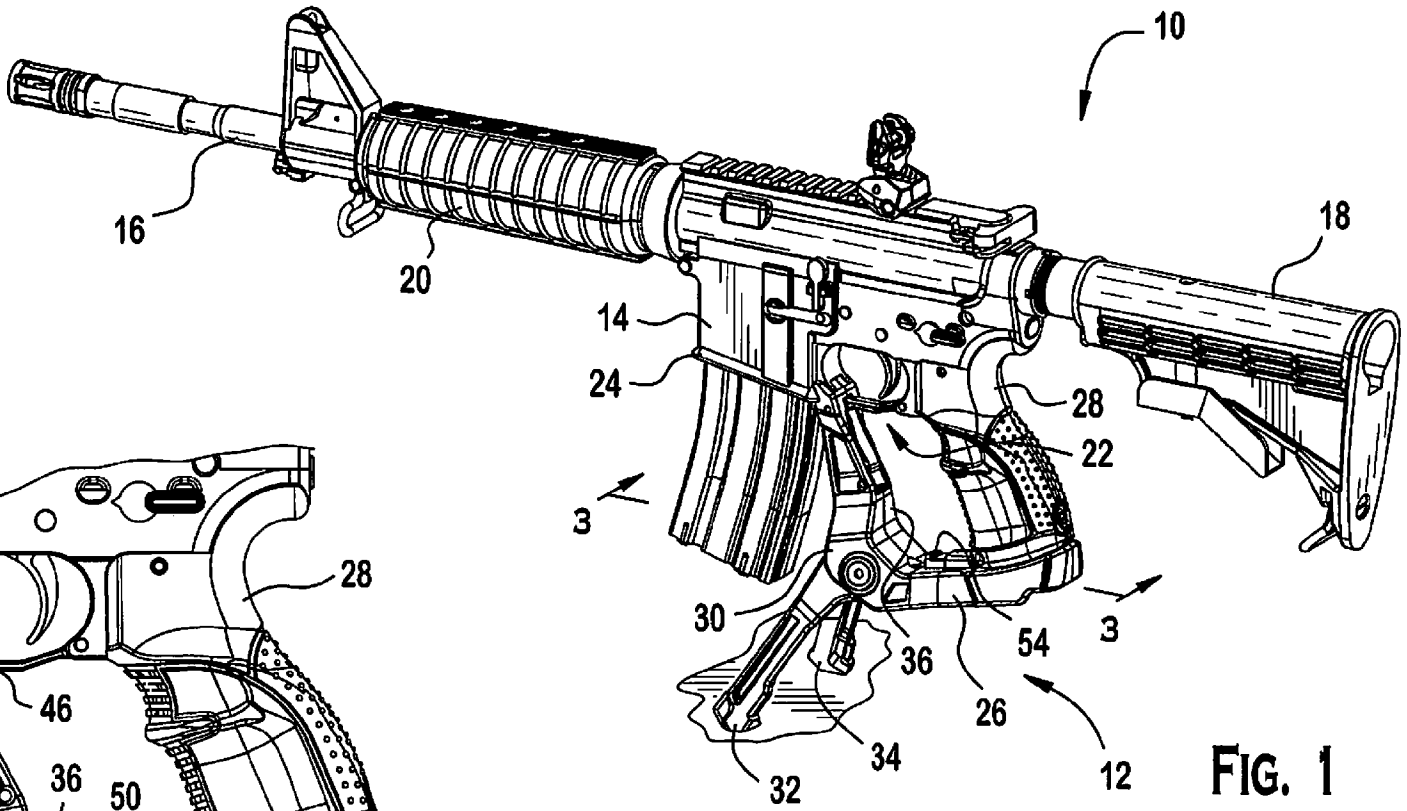
FIG. 1 is a perspective view of an exemplary embodiment of a pistol grip bipod in a deployed state.

FIG. 1 shows an AR-15 type rifle 10 with an exemplary embodiment of a pistol grip bipod 12. The rifle may include a lower receiver 14, a barrel 16, and a stock 18 which may be connected to the lower receiver. The rifle 10 further may include a hand-guard 20, a trigger guard assembly 22, and a magazine well 24. The pistol grip bipod 12 may include a bipod assembly 26 and a pistol grip 28.

The pistol grip bipod 12 may be connected to the magazine well 24, the trigger guard assembly 22, and the pistol grip mounting block (FIG. 3) of the rifle. The pistol grip bipod 12 may be adapted for use with other rifles.

The bipod assembly 26 may include a housing 30, a port side leg 32, a starboard side leg 34, which may extend from the housing 30 to form a bipod for the weapon. The pistol grip 28 may be an ergonomic pistol grip that includes over molded rubber components for enhanced grip and tactile response. The bipod assembly 26 further may include a brace 36 connected to another part of the lower receiver. For example, the brace 36 may be connected to the magazine well 24 and the trigger guard assembly 22. Thus, the brace 36 may form a trigger guard for the rifle's trigger, as well as a hand-guard for the pistol grip.

Figure 2:
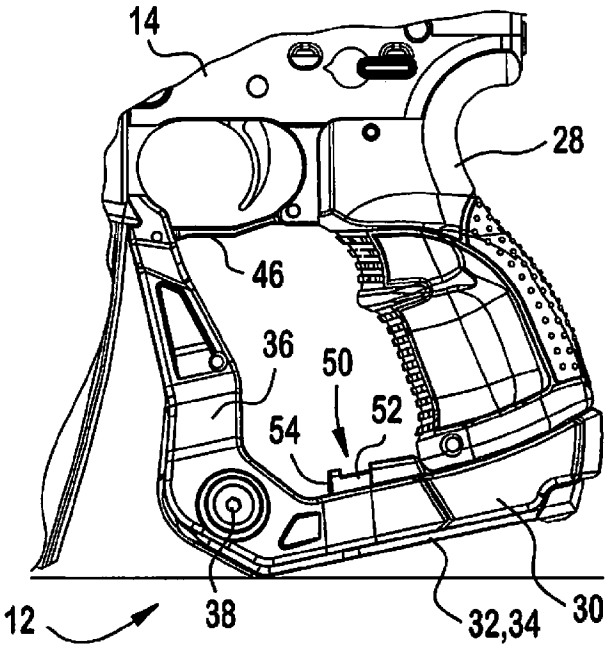
FIG. 2 is a side view of the pistol grip bipod of FIG. 1 in a retracted state.

FIG. 2 shows the pistol grip bipod 12 in a retracted state. In the retracted state, the pistol grip bipod 12 may present a streamlined profile. The bipod legs 32, 34 may be retracted into the housing 30. Each leg of the pistol grip bipod 12 may rotate about a pivot 38 that is located adjacent to the base of the brace. Each bipod leg may be secured into the housing 30 with a leg pivot fastening element 40. Each leg 32, 34 may be partially enclosed by the housing 30 which may prevent the legs from encumbering the firearm or entangling the bipod accessory with an operator's environment when the legs are not deployed.

The brace 36 may be connected to the lower receiver 14 at the rifle's forward trigger guard assembly attachment site 44. Additionally, the pistol grip bipod 12 may include a trigger guard 46 that may extend from the brace to the rifle's rear trigger guard assembly attachment site 48. Thus, the pistol grip bipod 12 may segregate the firearm trigger from the pistol grip bipod.

The pistol grip bipod 12 may be deployed by an activation device 50 located near the base of the pistol grip. The activation device 50 may be activated by sliding a control rod 52 rearward toward the pistol grip. The push-rod 52 may be located adjacent the pistol grip 12 such that an operator having a dominant hand that is holding the firearm by the pistol grip 28 may be able to move the control rod 52 in a rearward direction without removing the user's dominant hand from the pistol grip and without necessitating use of the operator's opposite hand.

Referring to FIG. 1, the control rod 52 may include a latch release button 54 which may have a streamlined profile. The latch release button 54 may be contained within the confines of the pistol grip bipod in order to deter inadvertent activation of the latch release mechanism. Further, the latch release button 54 may have a reduced profile that is streamlined and tapered toward the rear of the bipod housing to further deter inadvertent activation of the latch release button. Also, the latch release button 54 may travel linearly and may respond to directed force along the line of travel to further deter accidental deployment of the bipod legs.

Figure 3:
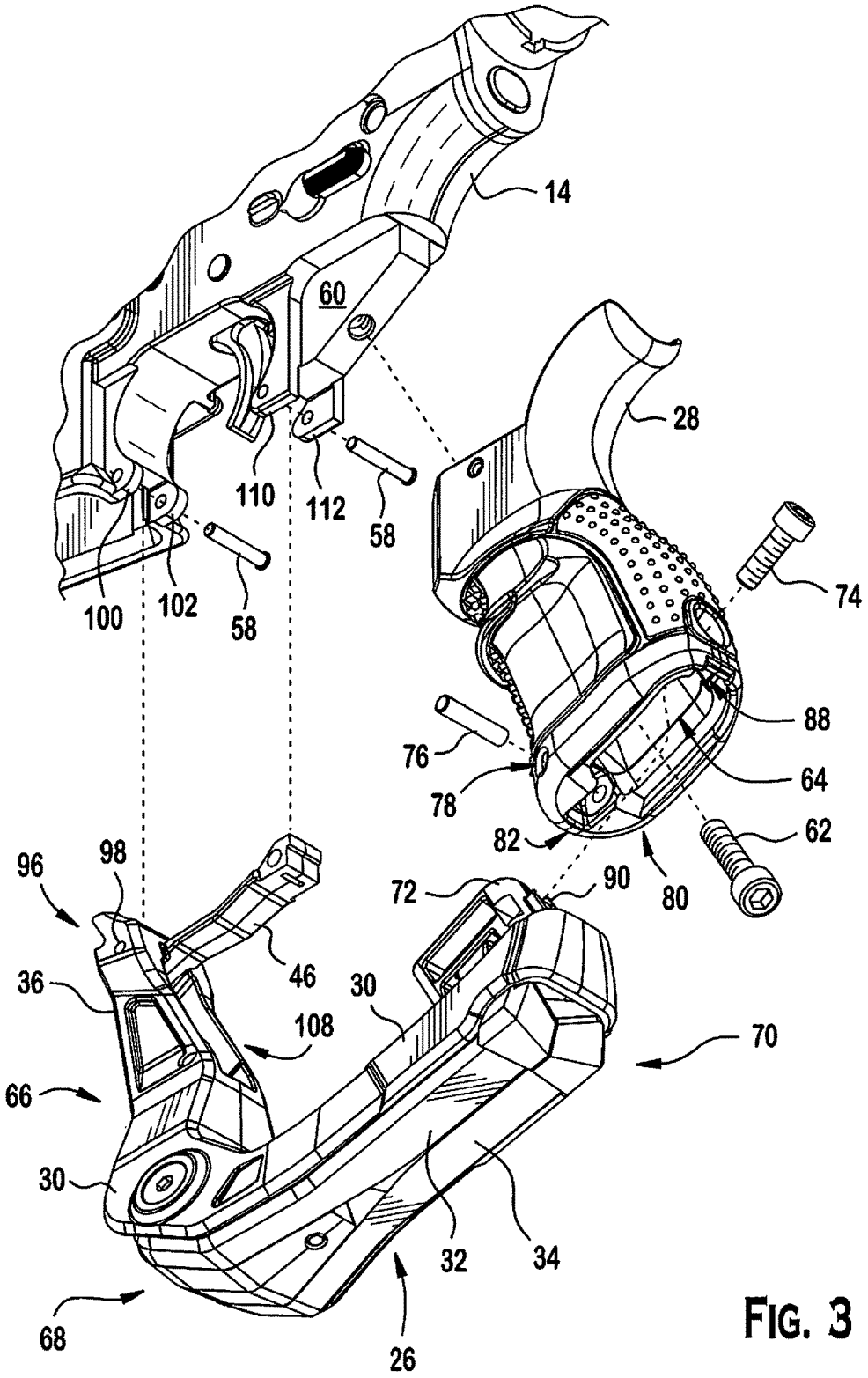
FIG. 3 is a partially exploded view of the pistol grip bipod of FIG. 1.

Referring to FIG. 3, the pistol grip bipod 12 may include a bipod assembly 26 and a pistol grip 28. The pistol grip bipod 12 may include pins 58 for securing the bipod assembly 56 to the trigger guard assembly 22 of the firearm. The pistol grip 28 may be secured to a pistol grip mounting block 60 on the lower receiver of the rifle. A pistol grip screw 62 may be threaded through an upper portion of the pistol grip into the pistol grip mounting block 60. Access to the upper portion of the pistol grip 20 may be provided by a cavity 64 in the pistol grip.

The bipod assembly 26 may include a housing 30 that includes a mast section 66, an intermediate section 68, and a receptacle section 70 for receiving the port side leg 32 and the starboard side leg 34. The receptacle section further may include a mounting block 72. The pistol grip cavity 64 may interlock with the mounting block 72. A screw 74 may be advanced through a rear bottom portion of the pistol grip and into the mounting block 72 to fix the pistol grip 12 to the housing 30. Also, a pin 76 may be used to secure the front of the pistol grip 28 to the housing 30. The pin 76 may be positioned perpendicular to the screw 74. The pin 76 may extend from a port side fastener hole 78 at the base of the pistol grip, through the pistol grip cavity 64, and into a fastener hole on the starboard side 80 of the pistol grip.

A recess 82 adjacent the cavity 64 may receive a mating projection 84 (FIG. 4) on the mounting block. The pin 76 may be driven through the fastener holes on the lateral sides of the pistol grip and through a corresponding pin hole 86 in the mating projection 84 that is disposed in the recess 82. Further, an interior portion of the pistol grip may include a slot 88 which is configured and dimensioned to connect with a mating track 90 on the rear side of the mounting block to prevent rotation of the bipod assembly with respect to the pistol grip.

Referring to FIG. 3, the bipod assembly 26 may include a housing 30, a port side leg 32, and a starboard side leg 34. The bipod assembly 26 further may include a brace 36 at the front of the housing 26. The brace 36 may include a notch 96 near the top of the brace. The notch 96 may be adapted to interlock with the magazine well 24 and adjacent trigger guard assembly 22 of the firearm. A fastener hole 98 may extend from the port side of the brace to the starboard side of the brace. The fastener hole 98 may be spaced from the notch 96 such that when the notch 96 is pressed into the magazine well between the port trigger guard assembly ear 100 and the starboard trigger guard assembly ear 102, the fastener bore in the brace is aligned with the fastener bores on the forward trigger guard assembly ears. A pin 104 may be placed in these fastener holes to secure the brace 32 to the lower receiver.

The bipod assembly 26 may include a trigger guard 46. The trigger guard 46 may extend from an area near the top of the brace 36 to a second location toward the rear of the bipod assembly. The trigger guard 46 may be pinned to the area near the brace such that it forms a hinged flap. The unpinned portion of the hinged flap may be positioned in a pocket 108 on the neck or pinned between the rear trigger guard assembly ears 110, 112.

Figure 4:
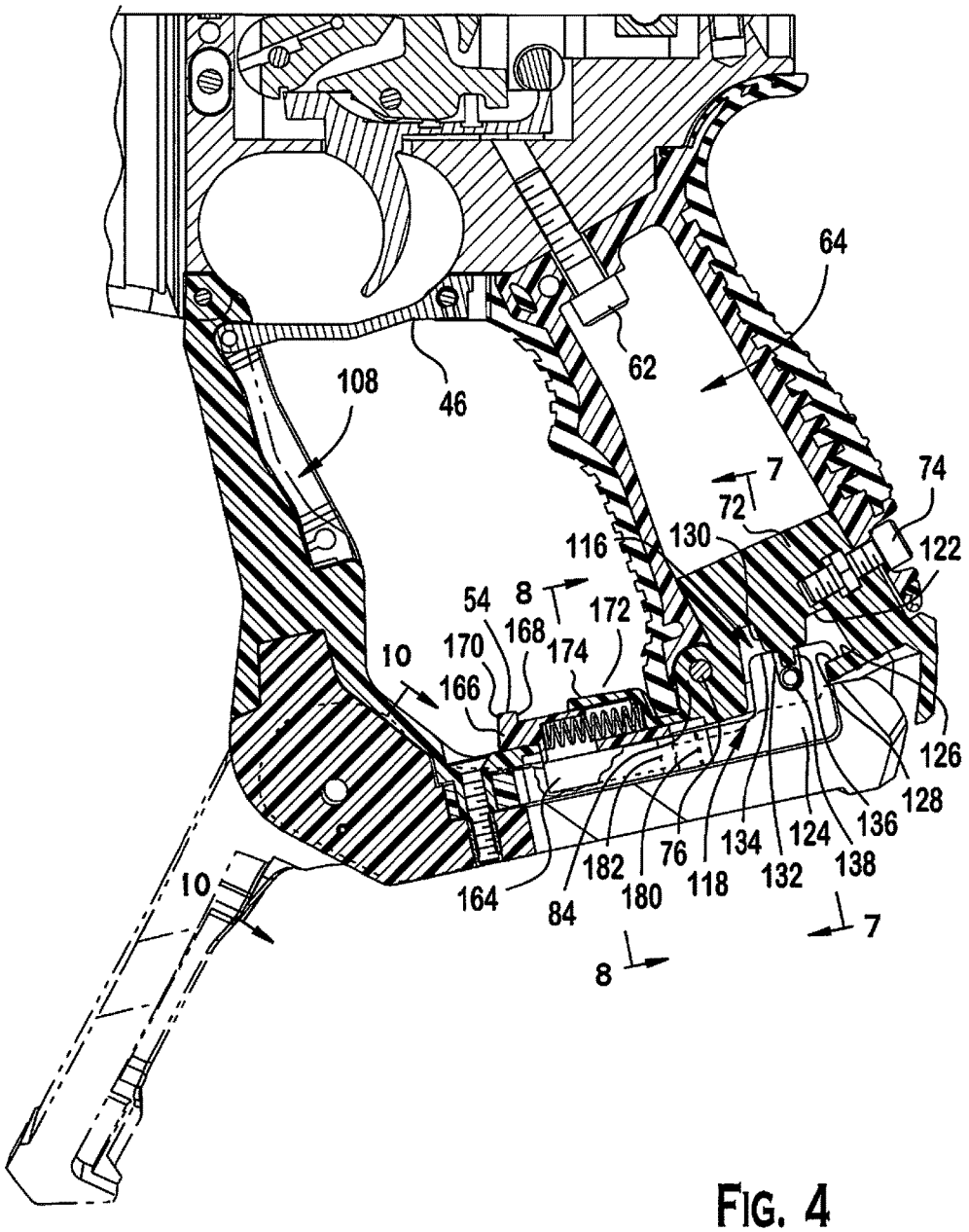
FIG. 4 is a cross-sectional view of the pistol grip bipod of FIG. 1, along line 3-3.

Referring to FIG. 4, the mounting block 72 may include a captured nut 114 within a pistol grip fastener receiving hole. The captured nut 114 may mate with the screw 74 that may be advanced through the rear bottom portion of the pistol grip 28 and into the mounting block 72 to fix the pistol grip to the bipod assembly 26. Additionally, a pin 76 may extend from a port side fastener hole 78 at the base of the pistol grip, through the pistol grip cavity 64, and into a fastener hole 80 on the starboard side of the pistol grip.

The mounting block 72 may include an internal chamber 116. The chamber 116 may be open to the underside of the bipod assembly housing 30 via a window 118. The chamber 116 may be configured and adapted to receive portions of a latching mechanism for retaining and selectively releasing the legs of the bipod assembly. The chamber 116 may include a raised ceiling 122 for accommodating a latching member 124. The chamber 116 may include a bench 126 upon which a bearing surface 128 of the latching member may rest. The chamber 116 further may include a projection 130 which extends downward from the chamber ceiling. The projection 130 may be configured and dimensioned to restrain vertical movement of the latching member 124. For example, the projection 130 may include one or more shoulders 132 which may contact the top edges 134 of the latching member in order to provide a surface that allows the latching member to move laterally but not vertically.

Figure 12:
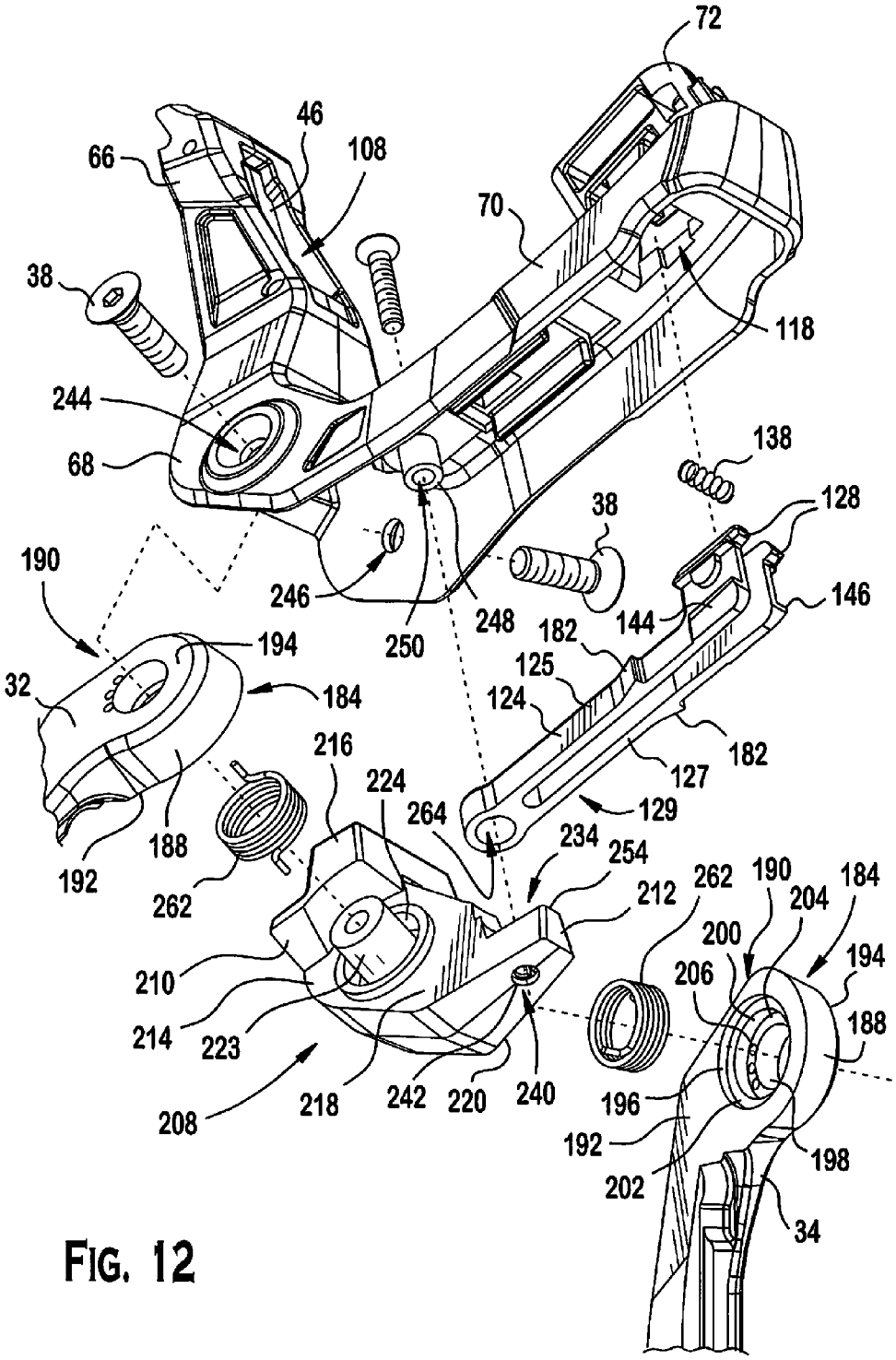
FIG. 12 is an exploded view of the pistol grip bipod of FIG. 1.

Additionally, the projection 130 may include a tip 136 which extends below the top edges 134 of the latching member 124 to help secure a compression spring 138 between opposing paddles 140, 142 of the latching member. Further, the tip 136 may act as a spacer for aligning the latching member 124 in the chamber. Referring to FIG. 12, the latching member 124 may include a first cantilever board 125 disposed in the receptacle section of the housing. The latching member 124 may include a second cantilever board 127 disposed in the receptacle section of the housing. The latching member 124 may include a U-shaped resilient member 129.

As shown in FIG. 7, the projection 130 may prevent each paddle 140, 142 of the latching member 124 from translating too far across the chamber 116. Each paddle may include a latch 144, 146 having a latching face 148, 150 which may secure the respective catch 152, 154 of the opposing leg of the bipod assembly. Also, the compression spring 138 may be positioned in an alcove 156 that may be disposed between the paddles 140, 142 of the latching member to further bias the latching member 124 into the expanded configuration. The lateral distance between the paddles 140, 142 may be increased, in the expanded configuration, such that each respective latch 144, 146 may be positioned to interlock with a catch 152, 154 on an opposing leg.

Further, each latch 144, 146 may include a tapered side surface 158 that allows an opposing tapered surface 160 on the associated leg to push the latches inward when the legs 92, 94 are closed and retracted into the receptacle 72. The tapered surface 158 of each latch and the associated opposing tapered surface 160 of each catch 152, 154 may push the latches 144, 146 toward each other until each catch clears the vertical face 162 of each respective latch. After the tapered side surfaces 160 of the legs clear the vertical faces 162 of the latches, the resilient properties of the latching member 124 and the spring forces applied by the compression spring 138 against the paddles 140, 142 may reposition the latching faces 148, 150 of each latch under the respective catch 152, 154 of each leg. In this fashion, the legs may be retracted and automatically locked within the housing.

Referring to FIG. 4, the latch release button 54 may include a channel 164 and a block 166 on top of the channel. The block 166 may cantilever over the front of the channel. The block 166 further may include a tuft 168 on the top of the block. The tuft 168 may be a vertical extension of the front face of the block. The front face 170 and tuft 168 may form a generally flat tapered surface which slopes toward the rear end of the latch release button. The rear side of the block further may include a recess 172 that extends into the block. The recess 172 may form a spring compartment that is configured and dimensioned to hold a portion of a latch release compression spring.

Referring to FIGS. 4, 8, and 9, the latch release button 54 may be disposed within a shroud 174 on top of the bipod assembly housing 30. The shroud 174 may partially enclose a pass-through 176 that opens to an interior portion of the housing. The block 166 may be telescopically received in the shroud 174, and the channel 164 may be disposed in the pass-through 176 and seated on top of and to the sides of the latching member 124. The latching member 124 may form a guide that allows the channel 164 to translate axially along the latching member. A latch release compression spring 178 may be positioned in the spring compartment 172 and positioned on top of the channel between the block and the shroud.

Figure 5:
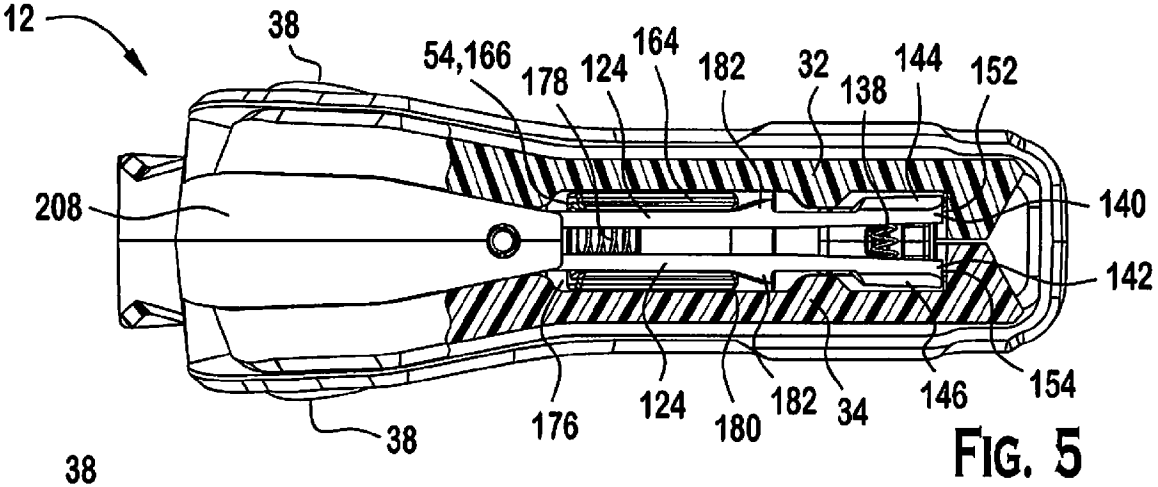
FIG. 5 is a bottom view of the pistol grip bipod of FIG. 1 in a retracted state, including a partial sectional view of the bipod legs.

In FIGS. 5 and 8, the latch release button 54 may be biased by the latch release compression spring 178 toward the front of the pass-through 176. The latching member 124 may be in the expanded configuration, and the legs 32, 34 may be secured in a retracted position by each respective catch 152, 154 (see also FIG. 7).

Figure 6:
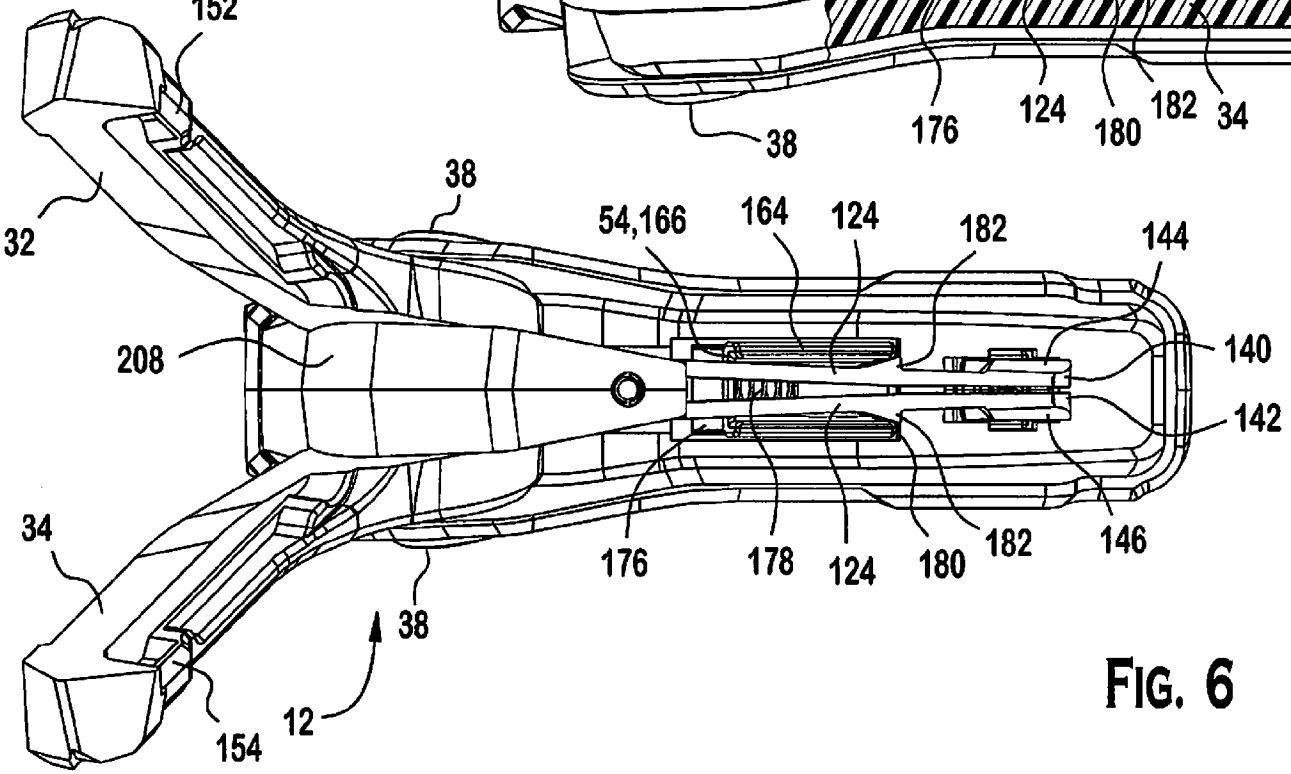
FIG. 6 is a bottom view of the pistol grip bipod of FIG. 1 in a deployed state.

In FIGS. 6 and 9, the latch release button 54 may be moved to a rearward position inside the pass-through 176 against the opposing spring force generating by the latch release compression spring 178. The leading end 180 of the channel may compress the latching member 124 into a retracted configuration.

In general, an operator may slide the latch release button 54 toward the rear side of the pass-through 176. As the channel 164 moves toward the rear of the housing, the leading end 180 of the channel may ride over a tapered segment 182 of the latching member 124. The tapered segment 182 of the latching member may include an outward facing ramp on each wing of the latching member. As the leading end 180 of the channel moves across the tapered segment 182, the outward facing ramp of each wing may be pushed laterally inward to compress the latching member 124. When the latching member 124 is compressed in this fashion, the latch 144, 146 on each respective paddle 140, 142 may move toward the center of the latching mechanism. Movement of the latches 144, 146 away from the respective catches 152, 154 may result in disengagement of each latch and its associated catch. As each respective latch 146, 146 disengages from its associated catch 152, 154, the affected leg may be unlocked and allowed to rotate away from the retracted position.

Figure 10:
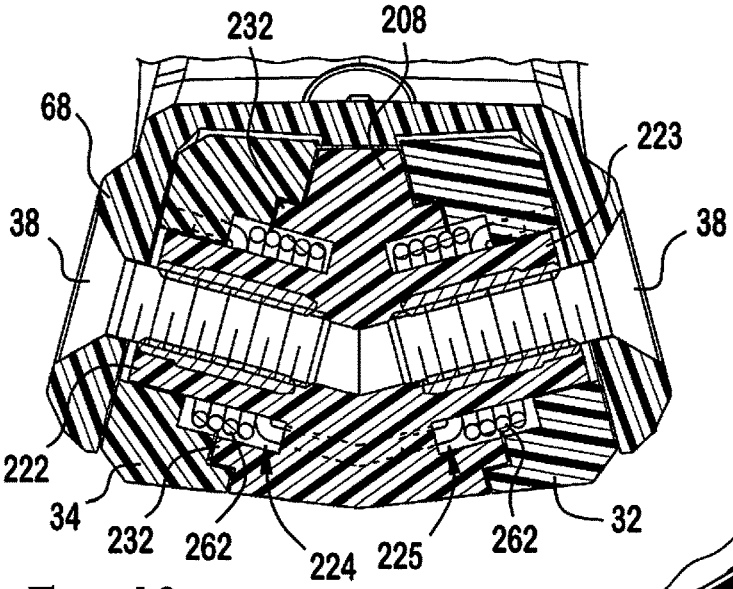
FIG. 10 is a cross-sectional view of the pistol grip bipod of FIG. 4, along line 10-10 with the bipod assembly in the retracted state.
Figure 11:
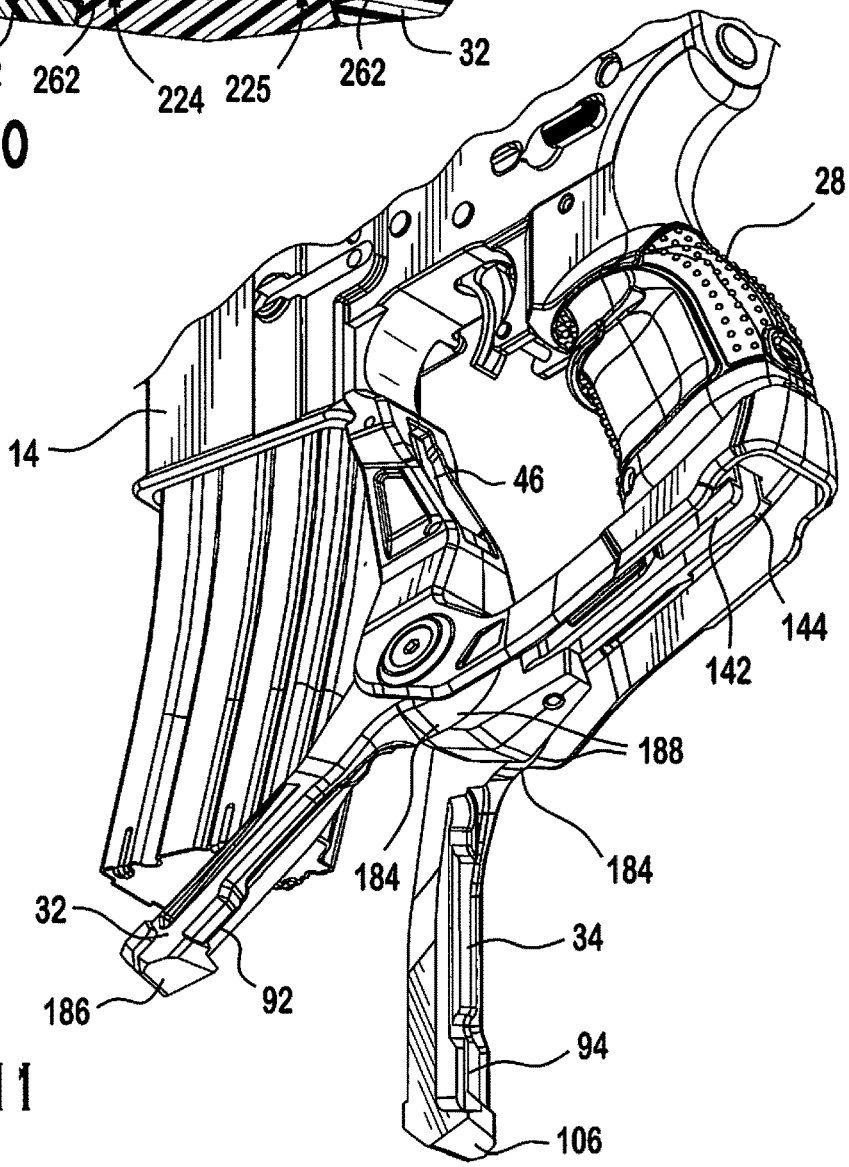
FIG. 11 is another perspective view of the pistol grip bipod of FIG. 1.

Referring to FIG. 11, the port side leg 32 and the starboard side leg 34 may each include a head 184, a foot 186, and catch 92, 94 disposed between the head and the foot. Referring to FIGS. 10 and 12, the head 184 may have a rounded side surface 188 and a passage 190 having a longitudinal axis that extends from an inner surface 192 of the head to an outer surface 194 of the head. The cross-section of the passage in a direction perpendicular to the longitudinal axis may vary along the axial length of the passage. The cross-section may be circular throughout. The diameter of the cross-section, however, may decrease from the inner surface to the outer surface. The passage 190 may include three segments of different diameter. The first segment 196 may be adjacent to the inner surface 192. The first segment 196 may have the largest diameter of the three segments. The second segment 198 may be adjacent to the outer surface 194. The second segment 198 may have the smallest diameter. A third segment 200 may be disposed between the first segment 196 and the second segment 198. The third segment 200 may have a diameter that is less than the first segment, but greater than the second segment. The passage may include a first end wall 202 at the junction of the first segment and third segment. Additionally, the passage 190 may include a second end wall between the second and third segments. The second end wall 204 may include one or more holes 206. The holes 206 may extend from the second end wall to the outer wall.

The legs 32, 34 may be mounted on a chassis 208. The chassis 208 may include a neck portion 210, a tail portion 212 spaced from the neck portion, and a middle portion 214 disposed between the neck portion and the tail portion. The neck portion 210 may include a trunk 216. The middle portion 214 may include a port side surface 218 and a starboard side surface 220. The port side surface 218 and the starboard side surface 220 of the middle portion may include a spindle 222, 223. The spindle 222, 223 may be centered in a hollow 224, 225. The base of the hollow may include a plurality of holes 226 extending into the chassis. The spindle 224, 225 may have a central axis and an end wall 228, 229 transverse to the central axis. The end wall may 228, 229 include a fastener receiving bore 230, 231. A raised ring 232, 233 may encircle the spindle 222, 223. The central axis of the port side spindle 222 and the central axis of the starboard side spindle 223 may intersect to form an obtuse angle in a generally horizontal plane. Also, the central axis of each spindle 222, 223 may intersect with an orthogonal vertical axis to form an acute angle.

Referring to FIGS. 4 and 12, the tail portion 212 may include a seat 234. The seat 234 may include an upper step 236, a lower step 238, and a fastener bore 240 in the lower step. The fastener bore 240 may include screw threads 242.

The bipod assembly housing 30 may include a mast section 66, an intermediate section 68, and a receptacle section 70. Generally, the mast section 66 and the receptacle section 70 may be disposed at an angle. The mast section 66 may be configured and dimensioned to mate with the trunk 216 on the neck 210 of the chassis 208. The intermediate section 68 and the receptacle section may be concave. The intermediate section 68 may include a port side through hole 244 and a starboard side through hole 246. The receptacle section 70 may include a circular cylindrical stem 248 that extends downward from the ceiling of the bipod assembly housing. The circular cylindrical stem 248 may include a centrally aligned through bore 250 that extends from the outer surface of the bipod assembly to the end face of the stem. The through bore may have a smooth side wall.

Referring to FIGS. 4, 10 and 12, the chassis 208 may be fixed to the mast section 66, the intermediate section 68, and the receptacle section 70. For example, the neck portion 210 may key into the mast section 66; the port side spindle 222 and the starboard side spindle 223 may be attached to the intermediate section via fastener screws 252 that may be received in the port side through hole 244 and a starboard side through hole 246, respectively; and the seat 234 may provide a foundation 254 for the circular cylindrical stem 248 such that the through bore in the stem 250 is aligned with the fastener bore 256 in the lower step when the receptacle section 70 is fit against the seat.

Additionally, the intermediate section 68 may partially enclose the chassis 208, a port side pivot leg assembly 258, and a starboard side pivot leg assembly 260. Each pivot leg assembly may include the head 184 of the respective leg, the spindle 222, 223 and ring 232, 233 on the associated side of the chassis, a torsion spring 262, and a socket screw 40 with a countersunk head. The countersunk head may include a flat top and a hex drive opening in the flat top.

Each pivot leg assembly may be secured to the intermediate section 68 to form a rotating and spring loaded joint. For example, a torsion spring 262 may be placed over one spindle 222 and into the adjacent hollow 224. One end of the torsion spring may be placed in one of the plurality of holes 226 that extend into the chassis. One leg 32 may be placed over the spindle 222 such that the second segment 198 may be mounted about the spindle 222, and such that the first segment 196 may be seated about the raised ring 232. The other end of the torsion spring 262 may be placed in one of the one or more holes 206 in the second end wall 204 of the leg.

The torsion spring 262 may be connected to the chassis 208 and the leg 32 such that when the torsion spring is in a less energized configuration, the foot 42 of the leg is positioned forward of the spindle 222. Additionally, the torsion spring 262 may be connected to the chassis 208 and the leg 32 such that when the torsion spring is in a more energized configuration the foot 42 of the leg is positioned rearward of the spindle 222.

Preferably, in the retracted configuration, the catch 152, 154 of the leg 32, 34 maybe interlocked with the associated latch 144, 146 of the locking member 124 to secure the foot 42 beneath the mounting block 72.

Referring to FIGS. 4 and 12, the lower step 238 may be configured and dimensioned to cooperate with the circular cylindrical stem 248 to form a forward mount for the latching member 124. For example, the proximal end of the latching member may include an eyelet 264 that is configured and dimensioned to be received about the circular cylindrical stem 248 such that the eyelet is anchored between the bipod assembly housing 30 and the chassis 208. A fastener 256, such as a socket screw, may be positioned in the through bore 250 of the stem, the eyelet 264 of the latching member and the fastener bore 250 in the lower step 240 to fix the tail portion of the chassis to the bipod assembly housing. The fastener bore 256 in the lower step and the fastener may include mating screw threads.

Figure 13:
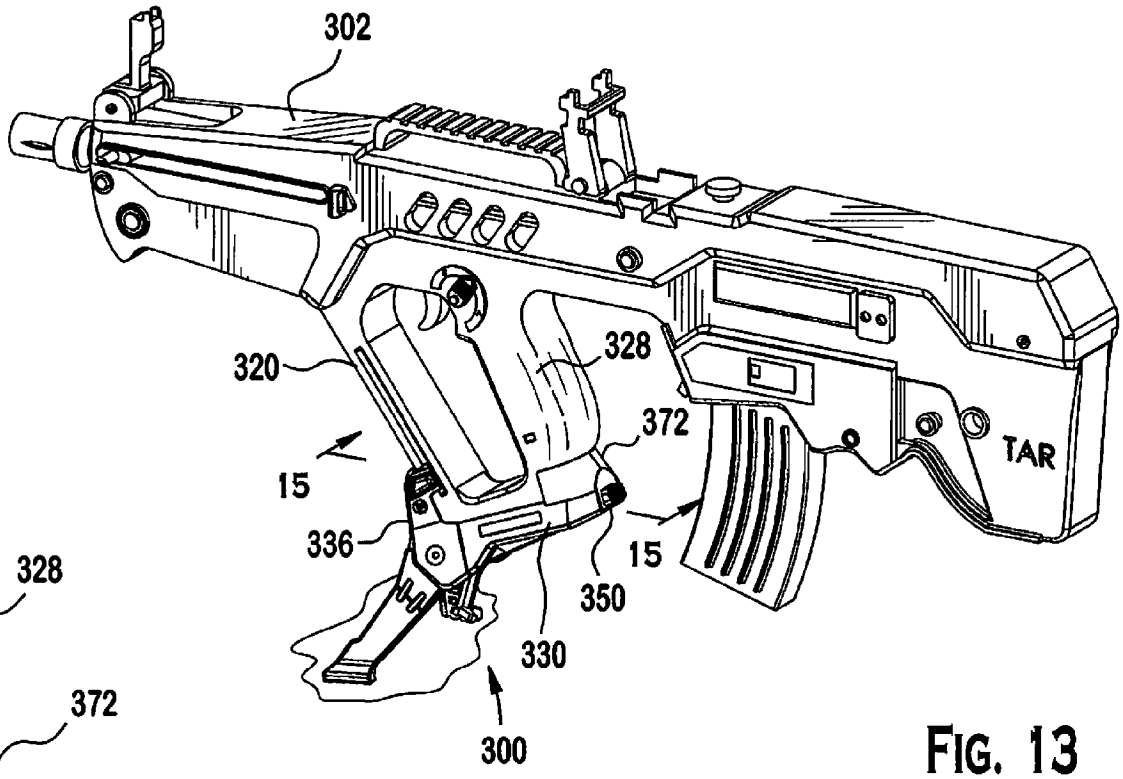
FIG. 13 is a perspective view of another embodiment of a pistol grip bipod in a deployed state.
Figure 14:
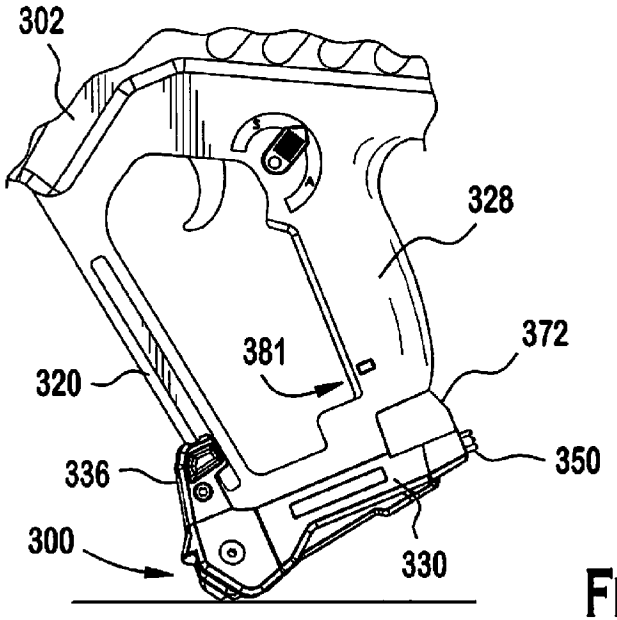
FIG. 14 is a side view of the pistol grip bipod of FIG. 13 in a retracted state.

FIGS. 13 and 14 show another embodiment of a pistol grip bipod 300 connected to another type of rifle 302 (i.e., a Tavor TAR-21). In this embodiment, the mounting block 372 forms a portion of the firearm's pistol grip; the brace 336 is connected to a hand-guard 320 that is disposed in front of the pistol grip; and the pistol grip bipod activation device 350 may be a latch release button that is disposed on the rear end of the bipod grip assembly housing 330.

In FIG. 13, the pistol grip bipod 300 is in a deployed state; whereas, in FIG. 14 the pistol grip bipod is in a retracted state.

Figure 22:
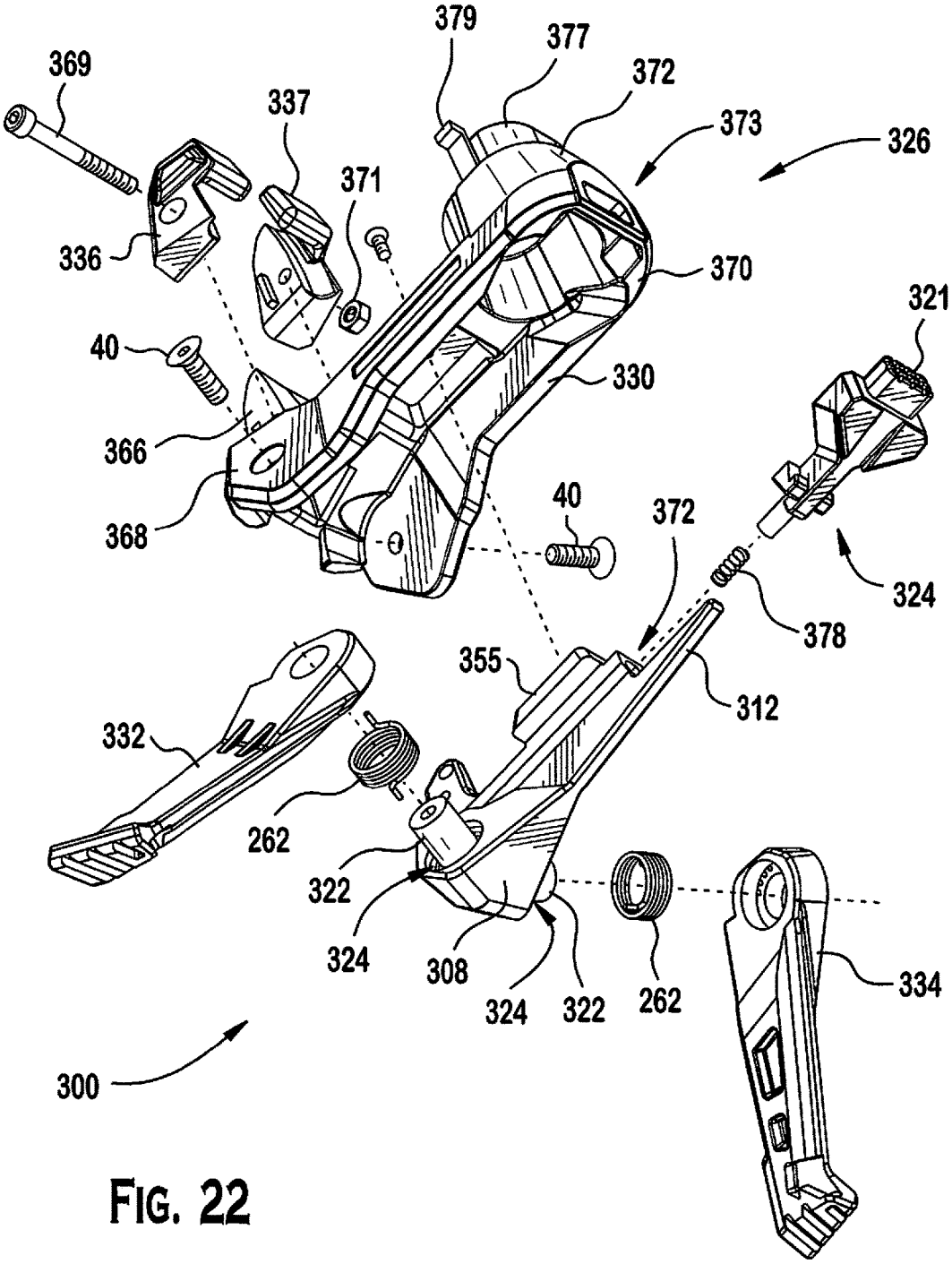
FIG. 22 is a partially exploded view of the pistol grip bipod of FIG. 13.

Referring to FIGS. 21 and 22, the pistol grip bipod 300 may include a bipod assembly 326 which is configured to mate with a pistol grip 328 of a rifle. The bipod assembly 326 may include a port side brace 336, a starboard side brace 337, a port side leg 332, a starboard side leg 334, torsion springs 262, a chassis 308, a latching member 324, a latching member compression spring 138, and a housing 330.

Referring to FIG. 22, the housing 330 may include a mast section 366, an intermediate section 368 and a receptacle section 370. The receptacle section 370 may include a mounting block 372 and a rear opening 373 for a latch release button 354. Referring to FIG. 15, the mounting block 372 may include a bench 375 for receiving the pistol grip of the firearm. Additionally, as shown in FIG. 16, the mounting block 372 may include a retaining wall 377 and a plurality of clips 379 that may be inserted into slots 381 in the pistol grip of the firearm to secure the mounting block to the pistol grip.

Figure 18:
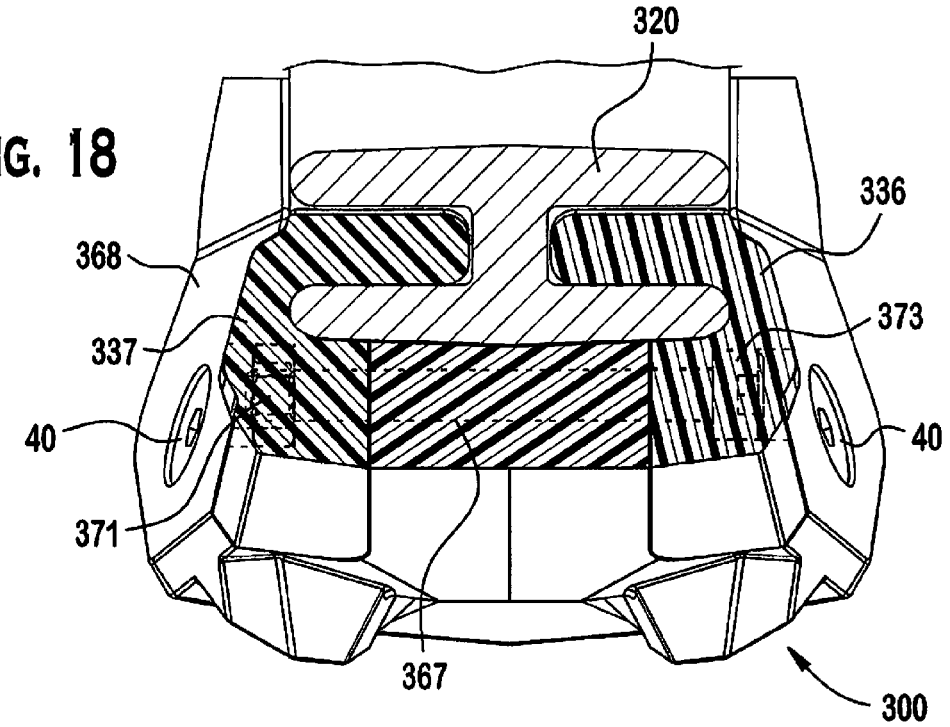
FIG. 18 is a cross-sectional view of the pistol grip bipod of FIG. 13, along line 18-18.

As shown in FIGS. 15 and 22, the housing 330 may further include an intermediate mounting plate 355 that may be configured and dimensioned to be received in a well 357 on the lower member of the firearm hand guard. Also, the mast section 366 may further include a through bore 367 for receiving a fastener 369 and a nut 371 that may be used to secure the port side brace 336 and the starboard side brace 337 to the mast section. As shown in FIG. 18, the head 373 of the fastener and the nut 371 may be disposed inside exterior segments of the through bore.

Figure 19:
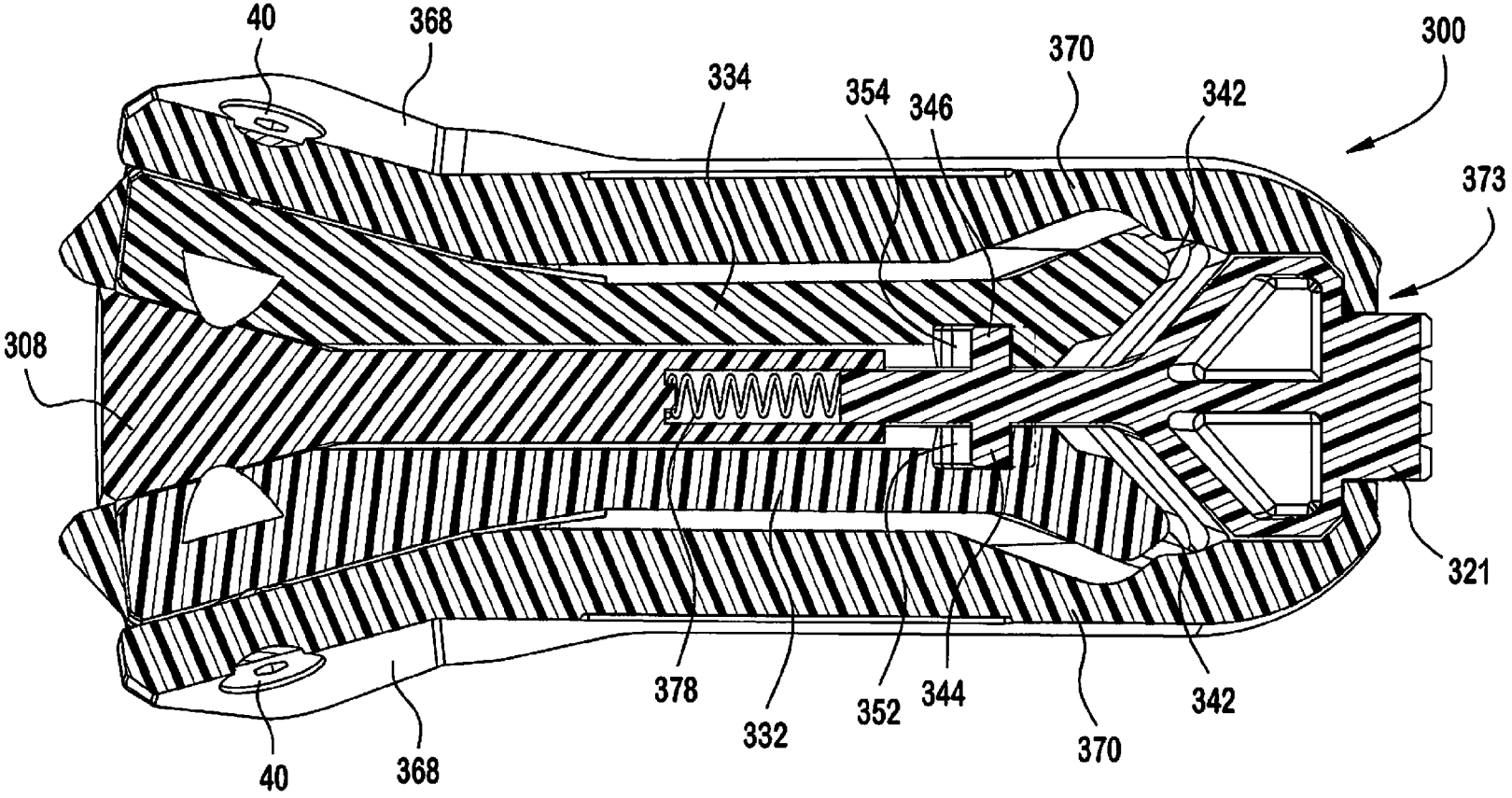
FIG. 19 is a cross-sectional view of the pistol grip bipod of FIG. 13, along line 19-19 with the bipod assembly in the retracted state.

Referring to FIGS. 19 and 22, the latching member 324 may include a push rod 320, a push button 321 on the rear end 322 of the push rod, a port side latch 344, and a starboard side latch 346. The front end 323 of the push rod may be positioned in a spring loaded recess 372 in the tail 312 of the chassis 308. The push rod 320 may be seated on top of the tail 312, and the push button 321 on the rear end of the push rod may be disposed in the rear opening of the housing. A compression spring 378 may be disposed in the recess 372 to bias the latching member 324 into the rear opening. The port side leg 332 and the starboard side leg 334 each may include a catch 352, 354. Each catch 352, 354 may interlock with the respective latch 344, 346 on the latching member 324.

Figure 17:
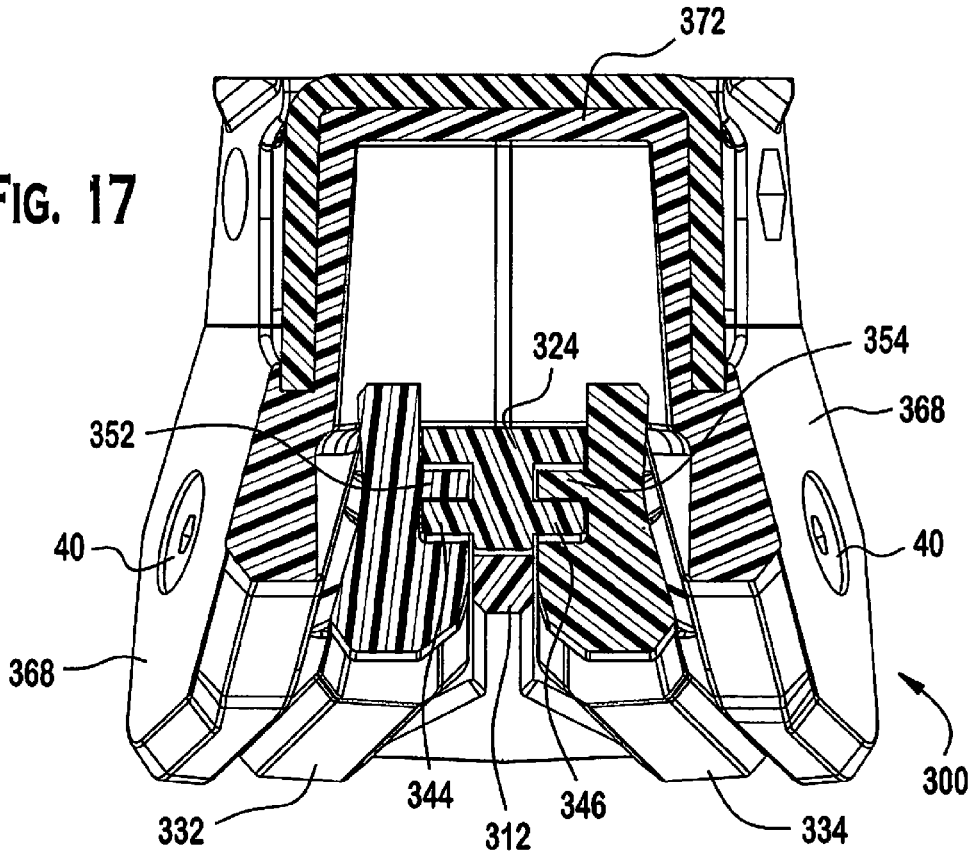
FIG. 17 is a cross-sectional view of the pistol grip bipod of FIG. 13, along line 17-17 with the bipod assembly in the retracted state.

In FIG. 17, each catch 352, 354 of the respective bipod legs 332, 334 are interlocked with port side latch 344 and the starboard side latch 346 of the latching member 324. In FIGS. 14, 16, 17, 19, 20, the bipod assembly 326 is in the retracted state. By contrast, in FIGS. 13 and 19, the respective bipod legs 332, 334 are unlocked from the port side latch 344 and the starboard side latch 346, and are biased in a deployed position. In FIGS. 13 and 19, the bipod assembly 326 is in the deployed state.

The operable configuration of the bipod assembly 326 in FIG. 19 may be changed by depressing the push button 321 into the housing 330. The forward movement of the push rod 320 may cause the latches 344, 346 to disengage from the catch 352, 354 in the legs. As shown in FIG. 20, the torsion springs 262 may store energy when the legs 332, 334 are rotated and retracted into the latching mechanism, but may release energy when the latches 344, 346 are disengaged. As shown in FIG. 21, the released energy from each torsion spring 262 may rotate the leg forward into a deployed position.

In use of the first embodiment of the pistol grip bipod, the pistol grip of the pistol grip bipod may be secured to the pistol grip mounting block of a firearm. The brace of the pistol grip bipod may be attached to another location on the firearm's lower receiver. For example, the brace may be connected to the magazine well and secured to the front trigger guard assembly. The mounting block may be inserted into the pistol grip cavity. The pistol grip may be fixed to the mounting block with a screw which may be advanced into the mounting block through a fastener hole situated near the base of the pistol grip. The bipod assembly leg may be rotated rearward such that the foot of each leg is positioned under the pistol grip. The legs may be retracted into the housing such that the catch on each leg may interlock with an opposing catch on the latching member.

In use of the second embodiment of the pistol grip bipod, the mounting block may be secured to the pistol grip of the firearm. The brace of the bipod assembly may be attached to the forward hand guard of the firearm. Also, the mounting plate may be inserted into the well of the lower hand guard. The bipod assembly legs may be rotated rearward such that the foot of each leg is positioned under the pistol grip. The legs may be retracted into the housing such that the catch on each leg may interlock with an opposing catch on the latching member.

In both embodiments, a firearm operator may hold the firearm's pistol grip with a dominant hand and the firearm's hand-guards with the non-dominant hand. The operator may operate the firearm trigger with the dominant hand while holding the pistol grip. The operator may selectively bias the pistol grip bipod into the deployed configuration from the retracted configuration by activating by a latch release mechanism on the bipod assembly housing. The latch release mechanism may be activated by the operator with the operator's dominant hand while holding the pistol grip.

In the first embodiment, the operator may activate the activation switch by pulling a latch release button rearward. The latch release button may be connected to a channel that is mounted on a latching member. The latching member may include two generally parallel spring boards. Each spring board may include a paddle and a latch on the paddle. As the channel slides over the latching member, the paddle may be squeezed together by the channel. As the spring boards are squeezed together the latch of each member may disconnect from the catch on the associated leg. After the catch and latch disconnect, the torsion spring may release stored spring forces to bias the leg into a deployed configuration.

In the second embodiment, the operator may activate the activation switch by pushing the latch release button forward. The forward movement of the push rod may cause the latches to disengage from the catch in the legs. After the catch and latch disconnect, the torsion springs release energy and rotate and bias each respective leg forward into a deployed position.

In both exemplary embodiments, the operator may retract the pistol grip bipod by folding the pivoted legs backward, until the catch and latch of each leg interlock to secure the latch in the retracted configuration. The operator may retract the pistol grip bipod with the operator's non-dominant hand while holding the pistol grip with the operator's dominant hand.

While it has been illustrated and described what at present are considered to be preferred embodiments of the present invention, it will be understood by those skilled in the art that various changes and modifications may be made, and equivalents may be substituted for elements thereof without departing from the true scope of the invention. For example, legs of the bipod assembly may be fixed as disclosed or of adjustable length. Additionally, features and or elements from any embodiment may be used singly or in combination with other embodiments. Therefore, it is intended that this invention not be limited to the particular embodiments disclosed herein, but that the invention include all embodiments falling within the scope and the spirit of the present invention.

What is claimed is:

1. A pistol grip bipod comprising:

a housing for attachment to a pistol grip, the housing comprising a mast section, and a receptacle section spaced from the mast section, the receptacle section comprising a mounting block for connecting to the pistol grip, an intermediate section disposed between the mast section and the receptacle section, the intermediate section comprising a port side hollow, and a starboard side hollow;

a first leg positioned adjacent to the port side hollow, the first leg comprising a first head, and a first foot spaced from the first head;

a second leg positioned adjacent to the starboard side hollow, the second leg comprising a second head, and a second foot spaced from the second head;

wherein the pistol grip bipod comprises first and second configurations such that in the first configuration the first foot and the second foot are positioned in the receptacle section proximate to the mounting block, and such that in the second configuration the first foot and the second foot are positioned in front of the mast section.

2. The pistol grip bipod of claim 1, wherein the mast section comprises a brace for securing the housing to a gun.

3. The pistol grip bipod of claim 2, wherein the brace comprises a notch, the notch being configured and dimensioned to mate with a trigger guard of the gun.

4. The pistol grip bipod of claim 1, wherein the mounting block is configured and dimensioned to be received within the pistol grip.

5. The pistol grip bipod of claim 1, further comprising a chassis connected to the intermediate section, the chassis comprising:

a neck, a port side spindle, a starboard side spindle, and a tail which includes a seat.

6. The pistol grip bipod of claim 5, wherein the first leg is pivotally connected to the port side spindle.

7. The pistol grip bipod of claim 6, wherein the second leg is pivotally connected to the starboard side spindle.

8. The pistol grip bipod of claim 5, wherein the receptacle section further comprises a stem, and the chassis is fixed to the stem.

9. The pistol grip bipod of claim 1, further comprising a port side latch proximate the receptacle section, and wherein the first leg further comprises a first catch adjacent to the first foot such that in the first configuration the port side latch and the first catch interlock to secure the first foot below the mounting block.

10. The pistol grip bipod of claim 9, further comprising a latching member that selectively positions the port side latch with respect to the first catch.

11. The pistol grip bipod of claim 10, wherein the latching member comprises a first cantilever board disposed in the receptacle section.

12. The pistol grip bipod of claim 11, wherein the latching member comprises a U-shaped resilient member.

13. The pistol grip bipod of claim 12, wherein the latching member comprises an eyelet adjacent the U-shaped resilient member.

14. The pistol grip bipod of claim 13, wherein the receptacle section further comprises a stem, and the eyelet is disposed around the stem.

15. The pistol grip bipod of claim 10, further comprising a starboard side latch proximate the receptacle section, and wherein the second leg further comprises a second catch adjacent to the second foot such that in the first configuration the starboard side latch and the second catch interlock to secure the second foot below the mounting block.

16. The pistol grip bipod of claim 15, wherein the latching member comprises a second cantilever board disposed in the receptacle section of the housing.

17. The pistol grip bipod of claim 16, wherein the latching member selectively positions the starboard side latch with respect to the second catch.

18. The pistol grip bipod of claim 17, wherein the mounting block comprises an internal chamber, and the port side latch and the starboard side latch are situated below the internal chamber.

19. A pistol grip bipod assembly for a gun comprising:

a pistol grip bipod of claim 1, and a pistol grip for a gun, the pistol grip being configured and dimensioned to receive the mounting block of the pistol grip bipod.

20. The pistol grip bipod of claim 1, further comprising a rod and a spring, the rod and the spring comprising a lengthened configuration and a shortened configuration such that in the lengthened configuration the spring biases the rod into a first position and the first foot is positioned in the receptacle section, and such that in the shortened configuration the rod is in a second position spaced from the first position and the first foot is positioned in front of the mast section.

21. The pistol grip bipod of claim 20, wherein the rod further comprises a button for positioning the rod.

22. The pistol grip bipod of claim 21, wherein the rod in the first position is nearer to the mast than in the second position.

23. The pistol grip bipod of claim 21, wherein the button is situated between the mast section and the mounting block.

24. The pistol grip bipod of claim 2, wherein the brace is configured to secure the housing to a rifle.

25. The pistol grip bipod of claim 2, wherein the brace is configured to secure the housing to a gun that comprises a muzzle and a magazine well, the brace being configured to secure the housing to the gun such that the magazine well is disposed between the muzzle and the receptacle section.

26. The pistol grip bipod of claim 2, wherein the brace is configured to secure the housing to a gun that comprises a muzzle and a magazine well, the brace being configured to secure the housing to the gun such that the receptacle section is disposed between the muzzle and the magazine well.

* * * * *